US006692232B1

(12) United States Patent
Letourneau

(10) Patent No.: US 6,692,232 B1
(45) Date of Patent: Feb. 17, 2004

(54) ROTOR ASSEMBLY FOR DISC TURBINE

(76) Inventor: Guy Louis Letourneau, 33470 Chinook Plaza, Scappose, OR (US) 97053

( * ) Notice: Subject to any disclaimer, the term of this patent is extended or adjusted under 35 U.S.C. 154(b) by 0 days.

(21) Appl. No.: 10/099,407

(22) Filed: Mar. 15, 2002

Related U.S. Application Data

(60) Provisional application No. 60/276,841, filed on Mar. 16, 2001.

(51) Int. Cl.[7] ..... F01D 5/14

(52) U.S. Cl. ..... 416/198 R; 416/198 A; 416/231 R; 416/231 B; 415/90

(58) Field of Search ..... 415/90, 216.1, 415/224; 416/198 A, 198 R, 231 R, 231 B, 4

(56) References Cited

U.S. PATENT DOCUMENTS

| | | | | | |
|---|---|---|---|---|---|
| 699,636 | A | * | 5/1902 | Thrupp | 415/67 |
| 1,061,142 | A | | 5/1913 | Tesla | |
| 1,061,206 | A | | 5/1913 | Tesla | |
| 1,455,022 | A | * | 5/1923 | Dake | 415/90 |
| 4,036,584 | A | * | 7/1977 | Glass | 415/90 |
| 4,218,177 | A | * | 8/1980 | Robel | 415/90 |
| 4,347,033 | A | | 8/1982 | Possell | |
| 4,832,573 | A | * | 5/1989 | Dorski | 416/241 A |
| 5,192,183 | A | * | 3/1993 | Wilkinson | 415/90 |
| 5,938,405 | A | * | 8/1999 | Coleman | 416/170 R |

FOREIGN PATENT DOCUMENTS

| | | |
|---|---|---|
| GB | 186082 | 9/1922 |

* cited by examiner

*Primary Examiner*—Ninh H. Nguyen

(57) ABSTRACT

A disc turbine rotor assembly comprised of spaced-apart discs includes means of spacing apart disc members of said rotor assembly, which allow for local variation and radial expansion under various local operating temperatures, without allowing axial deflection, deformation, or excessive warping of the disc material. Spacing means and positioning are provided which maintain desired gaps between planar disc surfaces, and may also establish tangential waves in the disc membranes in order to enhance boundary layer effects. Disc and spacer spokes combine to form a vane-axial type exhaust.

14 Claims, 5 Drawing Sheets

ROTOR ASSEMBLY FOR DISC TURBINE

CROSS-REFERENCE TO THE RELATED APPLICATION:

This application claims the benefit of U.S. Provisional Application No. 60/276,841, filed Mar. 16, 2001.

BACKGROUND OF THE INVENTION

1. Field of the Invention

This invention relates to a disc turbine rotor assembly comprised of spaced-apart rotor discs, and provides improvements to the coupling of the disc set to the rotor shaft, and spacing means of the disc members which allow local variation and radial expansion under various local operating temperatures without allowing axial deflection, deformation, or excessive warping of the disc material. Said means maintain desired gaps between planar disc surfaces, and additional spacing and positioning means are provided which establish tangential waves in the disc membranes in order to enhance boundary layer effects. Spoke features of the disc rotor stack are staggered so as to capture working fluid momentum during its axial egress.

2. Description of the Related Art

Turbines comprised of spaced-apart rotor discs were first described by Nikola Tesla in U.S. Pat. No. 1,061,142 and 1,061,206. For this reason, these turbines are sometimes referred to as Tesla Turbines, but are alternatively known as Prandtl layer turbines, boundary layer turbines, cohesion-type turbines, and bladeless turbines.

The turbine rotor consists of a stack of spaced apart discs fixed to a rotatable shaft. The rotor assembly is contained in a housing closely fitted to the perimeter of the discs. The discs have vents near the rotor rotational axis, and the housing includes at least one outlet positioned to receive fluid exiting the rotor assembly. In operation, an energetic fluid at pressure and temperature is introduced at the periphery of the rotor assembly and contained in a housing which closely follows the perimeter of the discs. The fluid passes between the discs and exits the stack assembly through the vents, leaving the housing through its outlets.

In operation, the tangential component of the flow of working fluid creates centrifugal force that must be overcome by additional fluid entering the housing. Therefore, during steady state operation, great back pressure is developed at the inlet of the machine, along with a significant drop in pressure between the inlet and the outlet of the machine. This drop in pressure, with its concomitant drop in temperature and expansion of the working fluid, efficiently extracts much of the available thermodynamic energy of the working fluid.

It is therefore understood that the highest operating temperatures of the working fluid exist at the periphery of the rotating disc assembly, and much lower temperatures exist in the axial regions near the outlets of the turbine. This radial temperature difference along the disc membranes, spokes, and other rotating components presents several material-related challenges, including undesired local and general warping of the disc membranes during extended use and especially after thermal cycles caused by intermittent use or periodically varying working fluid temperatures.

The typical failure mode of a rotor assembly composed of a stack of spaced apart discs is that permanent warping causes non-uniform spaces between the discs, even including closed off or occluded sections where warped material of one disc deflects enough to completely close the gap between it and its neighbor. A correspondingly wide gap area created on the reverse side of the warped disc admits of efficiency losses due to a lack of the close spacing required to maintain effective momentum transfer from working fluid passing through the enlarged section of the passage between the discs.

Prior art devices by Tesla and by Possell (U.S. Pat. No. 4,347,033) include pin members extending axially through several discs. This construction suffices when the device is used as a pump or compressor, but operation as a turbine produces local variations in temperature and differential thermal expansion. Disadvantageously, the pin members accumulate and communicate the forces and stresses of these differential material displacements across the several discs and thereby exacerbate the warping problem.

It is therefore advantageous to provide spacing means which maintain a uniform clearance within the entirety of the gap between opposed surfaces of the spaced-apart turbine discs, but it is also advantageous that these means allow local variation and radial expansion under various local operating temperatures, without allowing axial deflection, deformation, or excessive warping of the disc material.

In comparing the use of spacing means versus the simple robustness of a series of thick plates, it is understood that thinner plates with spacing means provide the same total active plate area at a reduced overall assembly axial thickness, and consequently more power is obtained for a given swept volume of a rotor assembly, thus improving efficiency. Assembly weight and material cost are reduced as well.

A generally known prior art method was initially devised and later taught away by Tesla in British patent 186,082, paragraphs 55–65: "Furthermore with the object of cheapening the manufacture I dispense altogether with the former spacing studs . . . accomplishing the spacing by means of small bosses or protuberances which are raised in the plates by blows or pressure."

Bumps and other features embossed on turbine discs have been employed to limited success as spacing means by individual experimenters and hobbyists to this day. Various inventors, including Conrad, et al, (U.S. Pat. No. 6,183,641) have provided bumps on a first turbine disc surface which do not protrude to closure against any second disc surface. Cafarelli (U.S. Pat. No. 5,470,197) has devised movable means of perturbing the fluid flow between the rotor discs. These inventions, however, do not serve to adequately prevent warping of the disc material or precise and uniform control of the spacing between the discs.

For most turbine applications, maintaining the whole of the disc membranes in flat planar states is desirable for smooth and continuous operation. However, other applications utilize pulsed combustion or pulsed variations of fluid pressures within the turbine. Since the ideal disc spacing for a given fluid at varies with its viscosity, which in turn varies with temperature and pressure, in these applications it is advantageous to present the working fluid with non-planar features within the space between rotor discs so that at any given moment at least some portion of the space between given discs is an optimum space for the fluid condition at any given portion of the pulse.

Another challenge inherent in the design of a disc turbine rotor assembly is the mechanism by which torque imparted to the discs by the working fluid is in turn transmitted to the shaft. Tesla's invention supplies hubs positioned axially fore and aft of the disc stack and includes threaded fasteners by which the assembly is brought into compression. The shaft, discs, and spacing washers deposed between the discs include at least one keyway, typically accepting of a square key. In the mechanical engineer's art, keyways are known to be features which concentrate working stresses and substantially reduce the design safety, requiring larger and heavier sections, increasing mass, cost, and design complexity.

In the typical, current, and prior art construction of a disc rotor assembly, the central vents form a radial array, and thereby form a radial array of material connections from a central disc hub to the planar membrane area where the working fluid transfers its momentum to the disc during operation. During this work, direction of fluid motion generally includes tangential and radial components, with very little axial displacement.

However, during egress through the series of vents, the fluid changes its direction from radial to axial motion. This change of motion inheres a change of momentum and therefore a reaction force, but prior art designs release the fluid with without substantially applying this available force to the rotational output of the turbine rotor. Commonly it is observed as a thrust load within the rotor shaft and opposed at the shaft bearings.

To increase the efficiency of the turbine rotor design, it is therefore of benefit to extract useful work from this portion of the working fluid momentum change in addition to the work extracted by the planar surfaces of the discs.

SUMMARY OF THE INVENTION

According to the present invention, spaced-apart discs comprising a disc turbine rotor are arranged in an axial stack. Spacing means are required in order to maintain the desired and optimal surface configurations of the planar surfaces of the discs, especially in their planar membrane areas distal to the rotor shaft where operating temperature extremes are greatest.

In the preferred embodiment, warping is prevented by spacing means deposed throughout the disc rotor assembly which maintain a predetermined gap between disc membrane surfaces.

The spacing means of this invention advantageously allow local differential expansion and displacements in radial and tangential directions in response to local variations of material temperature. By allowing these local radial and tangential shifts but without allowing axial deflection, substantially uniform axial clearances are maintained within the entirety of each gap between opposed surfaces of the spaced-apart turbine discs, but no accumulation or communication of forces and stresses of these differential material displacements are imparted from any one disc to any other disc.

Also, because the discs are not rigidly joined, rotor damage which might otherwise be caused by vibration or excessive speed is reduced or eliminated, because local excursions of material in a region of any one disc are not distributed to other discs.

In an additional embodiment preferred for pulsed combustion, the spacing means, plus axial compression of the entire disc array deform the planar surfaces of the discs into a substantially scalloped series of tangential waves. Rather than machining tangential wave features into the discs, discs made from planar sheet material can be deformed into the desired tangential wave shape by radially staggering the spacing means deposed within the disc stack, and then axially clamping the rotor disc stack. Although not within the scope of this invention, common and prior-art clamping designs include sandwiching the rotor disc stack between through-pinned hubs, or between a step feature of the shaft and threaded hub. A variety of snap rings are also available which provide axial take-up, and a pair of these can be installed in receiving grooves in the shaft so as to fix the rotor disc stack in an axially clamped state.

This invention further includes improvements to the design of a disc turbine rotor assembly secured through judicious selection of a rotor shaft cross section and a set of complimentary central apertures in the rotor discs and spacing members. Compared to prior art designs which use keyways or splined shafts, polygons, especially regular polygons, and most especially the hexagon is used to transfer the working fluid forces gathered by the discs into the shaft. Compared to the hexagon, a polygonal hole in a thin sheet having a greater number of sides also has a lower maximum allowable torque beyond which material failure occurs, but countervalingly, for a given cross sectional area, shafts of four or fewer sides are weaker in torsion because the torsional load accumulated in the apices of a shaft section varies according to the square of the distance from the center of the shaft.

Accordingly, several objects of the invention exist:

An object of this invention to provide means permitting radial expansion and contraction of a membrane portion of one individual rotor disc, being part of an axial array of similar discs which together comprise a disc turbine rotor assembly.

Another object is the accurate maintenance of a given and determined axial spacing between a local surface of a membrane portion of a first rotor disc, and a locally opposed surface of a membrane portion of a second rotor disc deposed at a given axial distance apart from said first disc.

A further object of this invention is to provide spacing means which allow for local variation and radial expansion under various local operating temperatures, without allowing axial deflection, deformation, or excessive warping of the disc material.

A yet further object of this invention is to provide a means of maintaining a uniform clearance within the entirety of the gaps between opposed membrane surfaces of a first disc and a second spaced-apart disc included as part of a disc turbine rotor assembly.

A yet further object of this invention is the reduction of total rotor assembly mass, weight, and cost, with its concomitant increase in operating efficiency by means of establishing localized positional control components which locally enforce the desired gap widths between membrane portions of the discs of the rotor assembly, it being understood that such effective spacing means allow a denser array of thinner plates providing larger total active plate area, and consequently secure more power obtained for a given swept volume of rotor assembly.

A yet further object of this invention is also to present a pulsating working fluid with non-planar variations of the space between rotor discs, by providing spacing means throughout the disc rotor assembly which, in assembly, deform the planar surfaces of the discs into a series of substantially scalloped tangential waves. The varying width of the space affords, for fluid at any given state of the pulse, at least one optimial region in which viscous boundary layer effects maximally transfer fluid momentum to the rotor discs.

A yet further object of this invention is the transmission of rotary power from the disc stack to the shaft by means of complimentary cross sections of the rotor shaft, the discs, and the spacing members, so that power transmission capability is enhanced, while mechanical complexity and component cost are reduced.

Another object of this invention is the transmission into rotary output power of useful work from the working fluid and during its direction and momentum changes from a substantially tangential and radial flow direction while at work in between the discs of the rotor stack assembly, to a substantially and axial flow direction while departing the rotor stack assembly.

DRAWINGS

FIG. 1: Disc turbine rotor assembly.

FIGS. 2 and 3: Prior art disc spacing by means of rivets.

FIGS. 4A and 4B: Disc spacing by means of upset studs.

FIG. 4C: Disc spacer bushings aligned in a stack.

FIGS. 5A and 5B: Disc spacing by means of pierced integral tabs.

FIG. 5C: Disc spacing by means of a formed and twisted protrusion.

FIGS. 6A and 6B: Disc spacing by means of stamped and formed clips.

FIG. 6C: Disc spacer with snap-in features.

FIGS. 7A and 7B: Disc spacing by means of a formed wire spacing component.

FIG. 8A: Prior art disc assembly with prior art offset spacers.

FIG. 8B: Disc assembly spacers force disc into scalloped shape.

FIGS. 9A and 9B: Prior art rotor assembly and spacers with parallel vents.

FIG. 10A: Improved rotor assembly with helically-arranged vents and spokes.

FIG. 10B: Cross section of spokes and spacer arms forming a vane-axial helix of constant pitch.

FIG. 10C: Cross section of spokes and spacer arms forming a union of two dihedrally joined helices of opposite-hand twists.

FIG. 10D: Improved rotor assembly including a blank disc.

FIG. 10E: Cross section depicting spokes and spacer arms forming a union of two dihedrally joined helices of opposite-hand twists, with a middlemost blank disc.

DESCRIPTION

FIG. 1 illustrates a rotor assembly for a disc turbine, including a rotatable shaft [1] to which is affixed a linear array of spaced-apart discs [2] which include central vents for working fluid passing through the spaces between the working surfaces of the discs [3]. Desired disc spacing is maintained proximal to the shaft [1] by means of spacing washers [4] which typically include protrusions which extend axially toward the working surfaces of the discs, and are typically congruent in shape with the pattern of spokes or similar portions of the disc material residing between the central vents [5] of the disc. In the figure, the first of the discs [2] is shown cut away to reveal a first such spacer [4].

In this embodiment, the rotor shaft [1] includes a hexagonal cross section [6], and the discs [2] and spacing members [4] mounted on the shaft all include closely-fitting hexagonal central openings. However, a central opening of any cross section may be employed which engineering practice determines is free of stress concentrating features, such as sharp, re-entrant corners. Serviceable cross sections for this application therefore include regular polygons, rectangles, and ellipsoids of two or more focii. Where manufacturing economy permits, a splined shaft may be secured and complimentary close-fitting apertures may be cut into the discs and spacing members by means of a broaching operation or by machining.

FIG. 2 illustrates a prior art spacing means in which a first series of spacer-laden discs [7] are interspersed with ordinary discs [8] in an alternating fashion. FIG. 3 illustrates this prior art spacing means in cross-section. The prior art spacers of FIGS. 2 and 3 are a plurality of cylindrical rivets [10] press-fit into at least one radial array of accepting apertures [9] of the spacer-laden disc [7]. FIG. 2B shows a partial cross section detail of this means as described. The cylindrical rivet [10] may be upset, brazed in place, or remain in position by force-fit alone, protruding away from the planar surfaces of spacer-laden disc [7] in both directions, so as to maintain design gaps between said disc [7] and its neighboring ordinary discs [8]. In accordance with commonly known engineering practice, the spacer rivet [10] is shown with a chamfer or a rounded edge at its area of contact with neighboring discs [8]. Said chamfer feature is obvious within the practice of mechanical engineering.

Proceeding to FIG. 4A, an additional disc spacing object of this invention is depicted. In this embodiment, the array of spacer accepting apertures [9] of the perforated, spacer-laden disc [7], accepts a spacer bushing [13]. The bushing [13] resides with its shank in an accepting aperture [9] of the spacer-laden disc [7] by force of press-fit alone, or in the case of more severe service, in the preferred embodiment said bushing [13] is subject to an upset operation after it is inserted, described further. The features of said bushing are examined in further detail in FIG. 4B. In the preferred embodiment, the base [14] of the bushing [13] includes a recessed area [15], and the opposite end [16] of the bushing includes an upper feature [17] admissible of an upsetting tool. This upper feature [17] includes a conical concavity, but other features including concave features, and especially including a spherical depression, are within the scope of the invention as well.

An assembly operation includes, after insertion of the spacer bushing [13] a post-insertion upset operation which deforms and spreads the bushing material protruding through the spacer accepting aperture [9] of the spacer disc [7]. The upsetting tool (not illustrated) includes a feature which is complimentary to the bushing upper feature [17], advantageously locating and centering said tool in a reliable and repeatable manner.

Due to material variances, the height dimension between the upper aspect of the deformed and upset bushing and the planar surface [3] of the spacer disc [7] may not be well controlled. In particular, the height, location, and finished form of the deformed rim may vary between items and between forming operations. Therefore, the spacer bushing [13] includes an accommodating recess [15] which may take the form of a conic section, a spherical vault, or any other sort of concavity.

Referring to FIG. 4C, it can be understood that a disc rotor assembly whose spacer receiving apertures align in assembly will align a plurality of a spacer bushings in a coaxial stack. It is further illustrated that within such a stack, the recess feature [15] of a first spacer bushing accommodates and avoids contact with the uncontrolled protruding form [18] of a second adjacent spacer bushing deposed abaft of said first spacer bushing. In addition, since the diameter of the clearance recess [15] of the first spacer exceeds that of the deformed protruding portion [18] of the second spacer, lateral motion of the first spacer with respect to the second is permitted.

It will be further understood by the above that tangential and radial shifts of a first rotor disc [7] within the aforementioned assembly stack are permitted independent of tangential and radial shifts of an adjacent second rotor disc [7], while axial deflection of any first rotor disc with respect to any adjacent second rotor disc is prevented. Therefore, local to the spacer stack, variations of gap widths between the planar membrane area of any first rotor disc and any adjacent planar membrane area of any second rotor disc, are advantageously eliminated.

It is also further understood thereby, that upon discerning the limiting distance within which warping of the disc turbine rotor assembly stack remains effectively and acceptably controlled, then one or a series of polar arrays of spacing means can be deployed among the spacing discs [7].

Continuing in the examination of FIG. 4C, it is seen that the disc turbine rotor assembly of the depicted embodiment is composed of a spaced array of discs, in which discs which deploy spacing means are adjacent to and in physical contact with other discs which also deploy spacing means. This arrangement of adjacent discs deploying spacing means remains within the scope of this invention even though the embodiments depicted in FIGS. 2 through 7 exclusive of FIG. 4, illustrate discs deploying spacing means alternating with discs devoid of said spacing means.

Proceeding now to FIGS. 5A and 5B, an additional form of spacing means for spaced-apart discs of a disc turbine rotor assembly is illustrated, comprising formed portions of the disc material itself. In this illustration, an aperture [9] in the spacer disc [7] includes at least one cantilevered protrusion [19] extending axially out of the plane of the disc membrane [3]. The distal portion of this cantilever is formed so as to extend in an axial direction, effecting thereby a protrusion spanning the gap between the spacer disc [7] and an adjacent disc [8]. Such protrusions are designed with sufficient sectional robustness so as to resist axial closure of the gap between a spacer disc [7] and an adjacent disc [8].

In the illustration of FIG. 5B, two cantilevers present a first spacing protrusion [19] in a first axial direction and a second spacing protrusion [19] in a second, opposite axial direction. However, an aperture [9] containing only one spacing protrusion [19], as well as an aperture [9] containing a plurality of spacing protrusions [19] all extending in a first axial direction, are also within the scope of this invention. Furthermore, an aperture [9] containing a plurality spacing protrusions [19], with at least one said protrusion extending in a first axial direction, with the balance of said plurality of protrusions all extending in a second, opposite axial direction, is indeed also within the scope of this invention.

In this embodiment, the apertures [9] of spacing disc [7] are non-round. A spacer [23] formed of a strip of material conforms to the profile of the aperture [9] and includes a central slot [24] passing through its midplane, of a width commensurate with the thickness of the spacing disc [7].

Spacers [23] are installed by lateral displacement so that the spacer material bilaterally athwart the spacer groove [24] embraces the material of the spacing disc [7]. The spacer [23], is preferably retained in position by interference fit and is ready for service upon full insertion.

Upon assembly, the spacing disc [7] with its spacers [23] present lateral spacing surfaces [29] which contact the planar membrane surfaces [3] of neighboring discs [8], establishing and maintaining the desired gap widths between the set of spacer discs [7] and ordinary discs [8] composing a disc turbine rotor assembly of the preferred embodiment.

Figure 6A:
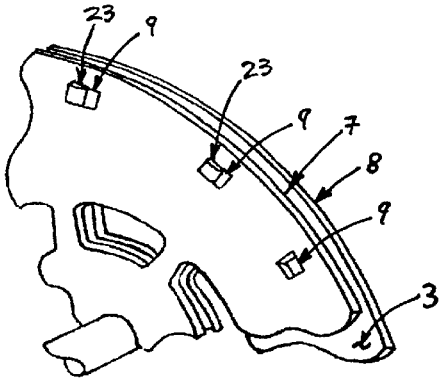
FIGS. 6A and 6B illustrate spacing means of an additional embodiment.
Figure 6B:
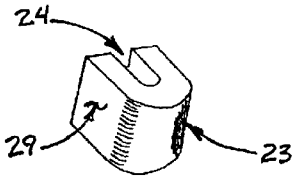
Figure 6C:
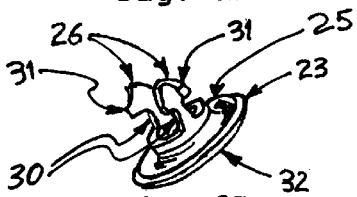

An additional and novel spacer design of this invention is illustrated in FIG. 6C: in this design, spacer [23] includes a head extending at least one resilient leg [30] extending through aperture [9] to snap through upon complete insertion. Such installation may be sufficient so long as the leg or legs are prudently designed to withstand insertion and residual tensile loads in service. Alternatively, additional means to secure such a snap-in spacer [23] to a spacer disc [7] may include means such as brazing, solder, welding, or adhesive.

In the preferred embodiment, a grommet, being a formed component, includes as its head a flange or flared brim [25] and also includes resilient legs [30] which upon installation depose themselves within and through the spacer receiving aperture [9]. Although any additional retention means may be employed as a post-insertion operation, in the preferred embodiment a snap-in, latching effect is secured by lateral projections [31] distally located on the resilient legs [30].

Upon installation, the spacer [23] presents a proximal surface or edge [25] into contact with the planar membrane surface [3] of spacer disc [7] in the vicinity of spacer receiving aperture [9], and thereby presenting an opposite surface [32] at a designed distance away from the planar membrane surface [3] of spacer disc [7]. During assembly and operation, said opposite, distal surface [32] contacts, spaces apart, and maintains a design gap width with respect to the planar membrane surface [3] of a neighboring disc [8].

Further study of FIG. 6C reveals an additional aspect of the invention. Extending, resilient legs [30] define a longitudinal axis, and include latching retention features [31] extending along lateral axes with respect to the longitudinal axes of the aforementioned legs [30]. In installation, the underside or proximal surface of this lateral projection [31] contacts the planar membrane surface [3] opposite the aforementioned planar membrane surface [3] with which the proximal surface or edge [25] of the spacer [23] is in contact as explained above.

The distal end of such a latching, resilient leg includes an upper surface [26] located at a designed distance from the underside surface of this lateral projection [31], so that upon assembly and operation the upper surface [26] of the spacer [23] contacts the planar membrane surfaces [3] of neighboring discs [8], establishing and maintaining the desired gap widths between the set of spacer discs [7] and ordinary discs [8] composing a disc turbine rotor assembly of the preferred embodiment.

Figure 7A:
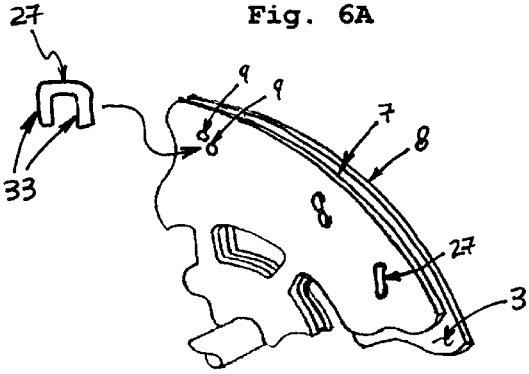
Figure 7B:
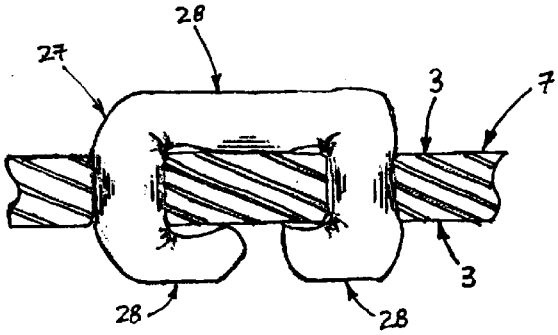

FIGS. 7A and 7B illustrate additional spacing means of this invention, utilizing in this case a formed wire spacer [27] including two extending legs [33]. In this embodiment, spacer receiving apertures [9] are substantially round holes deposed in pairs. However, other aperture shapes accepting of a formed wire spacer are within the scope of this invention as well.

A post-insertion forming operation bends the legs [33] flush to the surface [3] of the spacer disc [7]. This forming operation additionally deforms the material of the spacer [27] to create new distal surfaces [28] at a designed distance away from the disc planar membrane surfaces [3].

Upon assembly into a disc turbine rotor assembly, said distal surfaces [28] contact planar membrane surfaces [3] of neighboring discs [8] and establish maintain design gap widths between the set of spacer discs [7] and discs [8] composing a disc turbine rotor assembly of the preferred embodiment.

Figure 1:
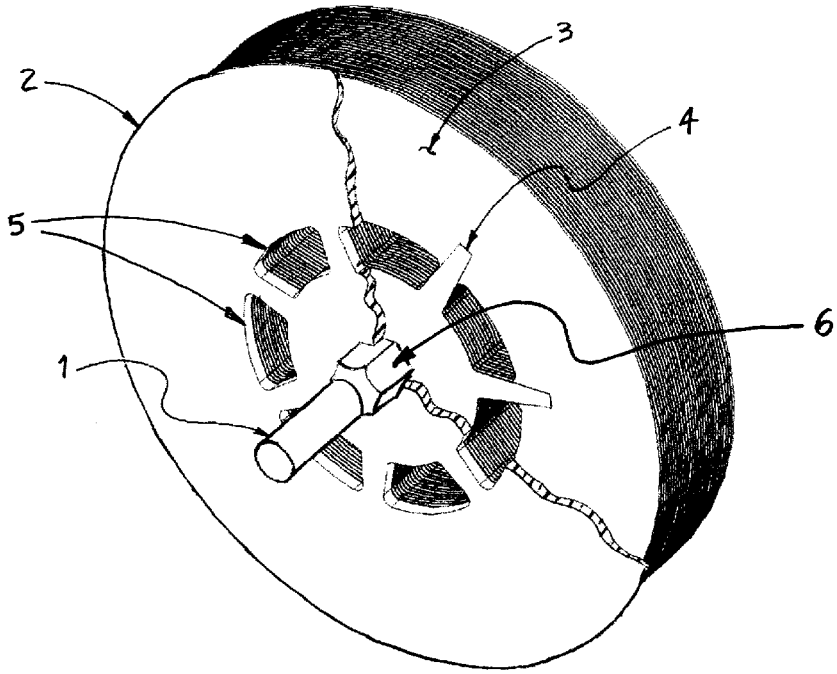
Figure 2:
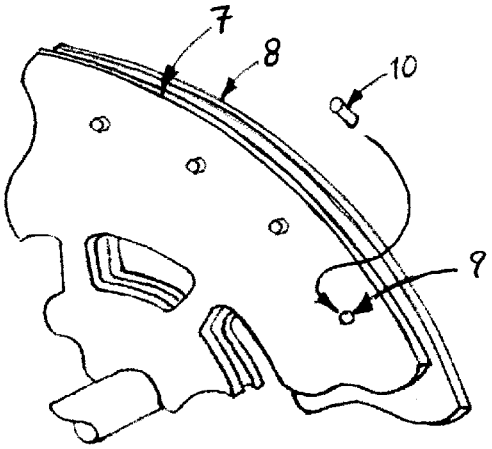
PRIOR ART Fig. 2.
Figure 3:
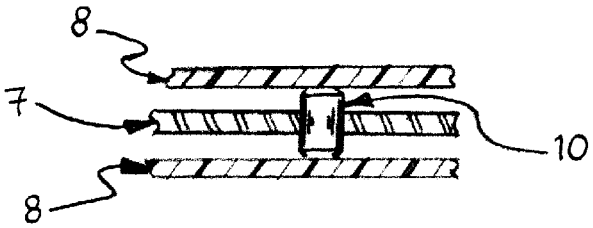
PRIOR ART Fig. 3.
Figure 8A:
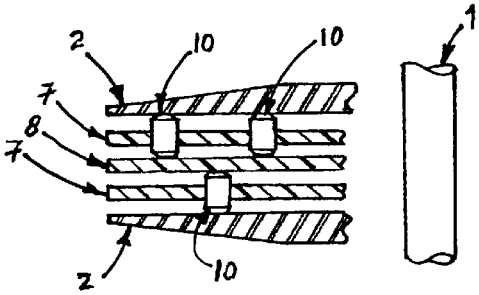
PRIOR ART Fig. 8A

Reminiscent of FIGS. 2 and 3, FIG. 8A illustrates spacing means of a prior art. As described previously, a disc turbine rotor assembly may deploy a first series of discs [2] and [8] devoid of spacers, alternating with a second series of spacer-laden discs [7]. The locations of the spacers [10] may be coaxial, as is preferred for the bushing style of spacer, or may be deployed in a first pattern on a first disc [7], and deployed in a second, offset pattern on a second spacer disc [7], with an intervening ordinary disc [8] having no spacers. This arrangement is illustrated in FIG. 8A, and has been graphically disclosed in the figures of the British Patent No. 186,082 by Tesla in the year 1922, but not thoroughly explained as such in the written portions of that patent. Nevertheless, such an arrangement is prior art, and currently resides in the public domain.

Figure 8B:
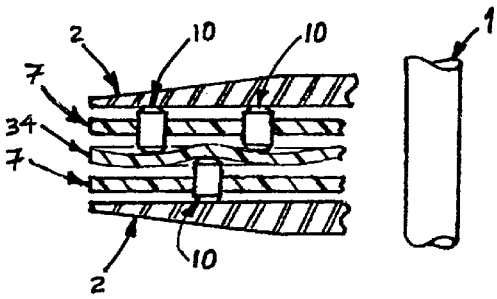

An improvement to this arrangement, useful in applications whose working fluid requires non-uniform gaps for most efficient boundary layer momentum transfer, is secured by compressing the assembled disc stack so that the interaction of opposing compressive forces on an intervening disc [8] by offset patterns of spacers [10] on bilaterally adjacent discs [7] deflects said intervening disc [8] into a tangentially undulating form, reminiscent of the wavy surface of a scallop shell. This arrangement is shown in FIG. 8B, where the scalloped disc is specially identified as item [34]. As briefly discussed previously, methods by which compressive forces are generated in end discs [2] and applied throughout the disc assembly are not within the scope of this invention.

Although in FIG. 8B only one disc [34] is shown, it is understood that a disc turbine rotor assembly may have a plurality of any number of discs [8] sandwiched between spacer discs [7] so that end compression applied by end discs [2] deflects the plurality of flat discs [8] of FIG. 8A into a plurality of scalloped discs [34] of FIG. 8B. In preferred embodiment, the resulting undulation waveforms are of uniform amplitude and angular wavelength within the plurality of scalloped discs [34], but not necessarily in phase with each other. For most harmonious dynamic balancing and smooth rotational operation of the rotor assembly, the preferred embodiment presents a staggered series, also known as a phased array, of the waves within the plurality of discs [34].

An additional embodiment, preferred by virtue of radial symmetry and accompanying ease of balancing, aligns the angularly undulating features of each successive scalloped disc [34] to be exactly out of phase with the next and the previous scalloped disc [34] of the series of scalloped discs included in the rotor disc assembly.

Figure 9A:
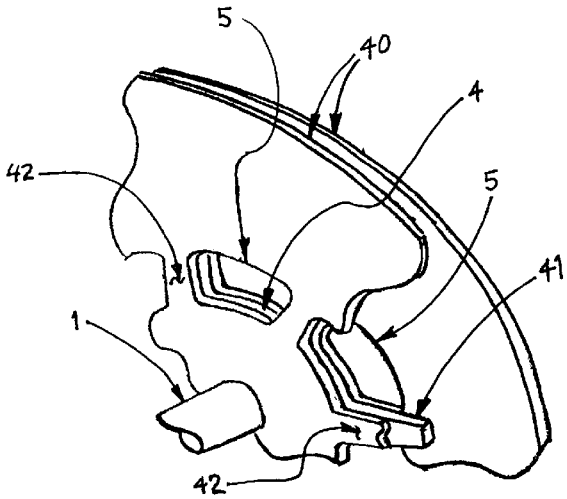
PRIOR ART Fig. 9A

Studying now FIGS. 9A and 9B, the arrangement of the spokes and vents of a prior art disc turbine will be discussed first, so that the improvements of this invention to these components will be further understood.

Figure 9B:
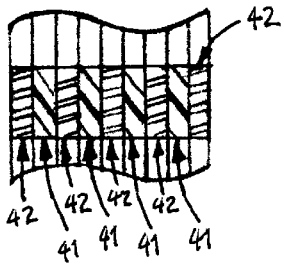
PRIOR ART Fig. 9B

As illustrated in FIG. 9, discs comprising a disc turbine rotor assembly are mounted on a shaft [1] and interspersed with spacing members [4] proximally mounted on the shaft. As discussed previously, most of the turbine rotor discs [40] include at least one vent [5] located proximally to the rotor shaft. The preferred embodiments deploy a radially symmetric array of such vents [5] on each disc [40]. The material remaining between the vent array is therefore deposed as a radial array of projections commonly referred to as spokes [42]. Similarly, the spacing members [4] include radial projections [41] substantially congruent in form to said spokes [42], which typically project partway into the planar membrane portions of the rotor discs [40]. Most importantly diagnostic of the prior art, however, is that the spokes [42] of the rotor discs [40] and the radial projections [41] of the spacing members [4] are aligned in parallel axial stacks, so that a plane can be found substantially containing: radial axes or datum target features of a plurality of spokes [42], radial axes or datum target features of a plurality of spacing member projections [41], and the centerline axis of the disc turbine rotor assembly. FIG. 9B, a cross section, clearly illustrates said axial and parallel alignment of these features.

To summarize this aspect of the prior art, in a typical disc turbine rotor assembly of the prior art, discrete pluralities of disc vents [5], disc spokes [42], and shaft-mounted spacing member radial projections [41] are coaxially aligned in a form reminiscent of shaft splines or a paddle wheel.

Figure 10A:
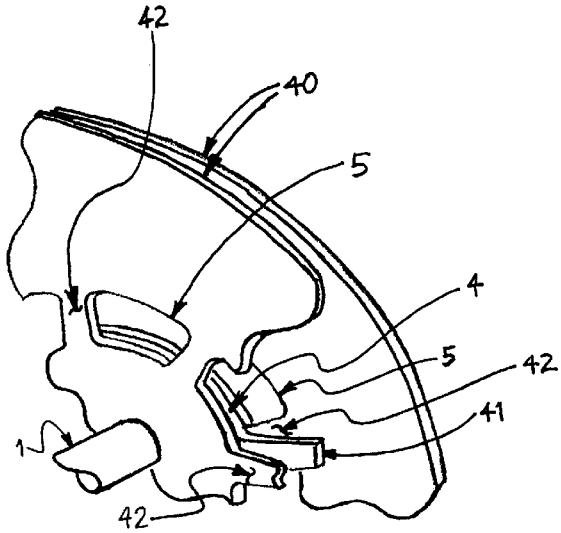
Figure 10B:
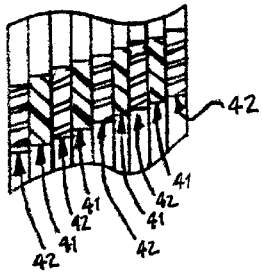

Now in FIGS. 10A and 10B will be seen an improvement on the prior art regarding the arrangement of the aforementioned features: This invention includes a disc turbine rotor assembly in which, for a first linear array of rotor discs [40] coaxially interspersed with a second linear array of spacing members [41]. The improved novelty is that a set or a subset of the radial projections [41] of the spacing members [4], and the spokes [42] and vents [5] of the discs [40] are indexed at angular offsets as one proceeds in an axial direction along the rotor assembly stack. This arrangement is illustrated in FIG. 10A as a partial oblique view, and in FIG. 10B as a cross section view.

Working fluid exiting the spaces between planar membrane surfaces of the rotor discs [40] impinges upon the indexed set of spokes [42] and spacing member radial projections [41]. When arranged in a sequential, indexed series of offsets as depicted in the cross section view of FIG. 10B, this united set of features substantially acts as an axial vane, exacting additional reaction force and motive power from the working fluid as it moves in an axial direction to exit the disc turbine rotor assembly.

In a design for operation wherein the direction of said egress is primarily in one axial direction, so that the working fluid exits from only one side of the rotor assembly, spokes [42] and spacing member radial projections [41] are arranged in a single helical collection as shown in FIG. 10B. However, in the preferred embodiment, working fluid leaves both sides of the disc rotor assembly. In this sort of embodiment, the spokes [42] and radial projections [41] are preferably collected to form a dihedral union of two helices of opposite-handed twists, as illustrated in cross section in FIG. 10C. Also, for the preferred embodiment in which working fluid leaves both sides of the disc rotor assembly, it is further preferred that the middlemost disc of the rotor assembly be a blank disc [43] devoid of vents, as illustrated in FIGS. 10D and 10E. For this sort of assembly, the scope of the invention includes the indexed series of offsets of the remaining set of vented discs and shaft-mounted spacers.

For engineering simplicity, an increment series can be defined as a mathematical set of numbers. The number of digits within the set is less by one than the sum of the number of rotor discs plus the number of shaft-mounted spacing members in the rotor assembly.

Thus, an assembly of five discs and four spacing members, whose respective spokes and radial projections are indexed by two degrees of arc from component to component, which in this case proceeds from disc to spacing member to disc to spacing member, may be written as the set of eight values {2, 2, 2, 2, 2, 2, 2, 2}. Such an arrangement would have a cross section as illustrated in FIG. 10B, and substantially form a vane of constant helical pitch. For the same number of example components arranged to form the dihedrally joined helix pair vane described above, a series such as {2, 2, 2, 2, −2, −2, −2, −2} may be used.

Figure 10C:
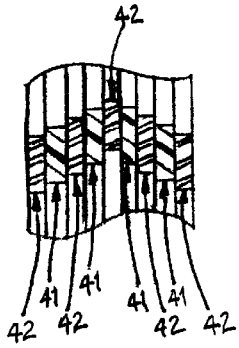
Figure 10D:
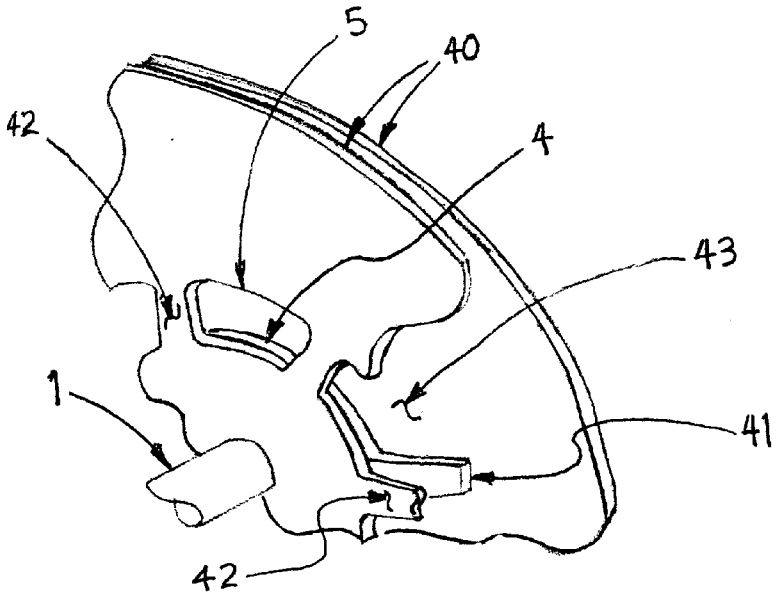
Figure 10E:
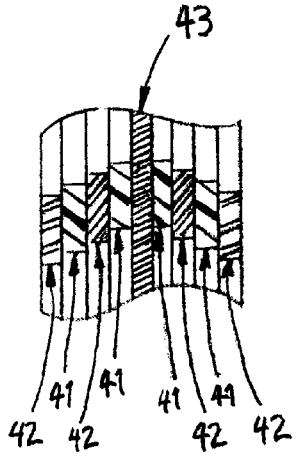

Understanding the increment series notation so explained, and referring now to FIGS. 10A, 10B, and 10C, and the discussion of spokes [42] and spacing member projections [41] arranged in a sequential, indexed series of offsets, it is further understood that both linear and non-linear offset functions are within the scope of the invention. For example, although the preferred embodiment for an application for one particular working fluid may include an angular offset of 3 degrees of arc between one axial item and the next, resulting in collections of radial vanes of constant helical pitch, another working fluid may require a non-linear, accelerating helical pitch, such as the angular offset increment series {1, 3, 5, 7, 9 . . . } which is also within the scope of this invention.

Furthermore, turbine bucket features useful in some working fluid applications can be formed by means of a central dwell of the increment series, such as {−4, −3, −1, 0, 0, 0, 1, 3, 4}.

Figure 4A:
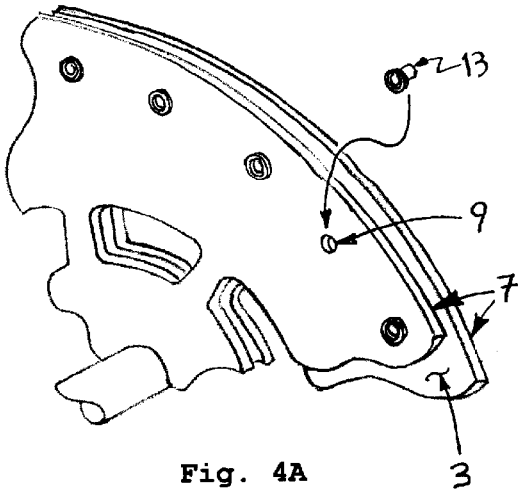
Figure 4B:
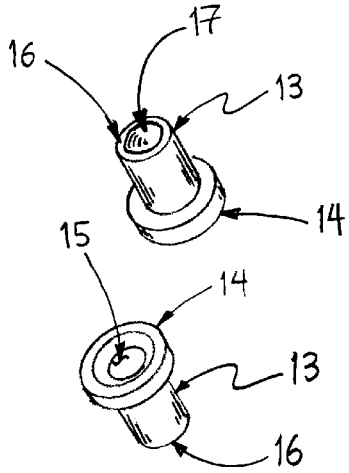
Figure 4C:
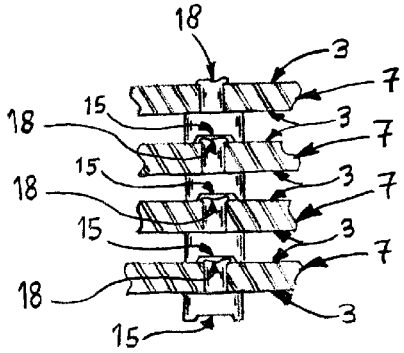

Although the description above contains many specificities, these should not be construed as limiting the scope of the invention, but as merely illustrative of the most preferred embodiments. For example, in the bushing [13] of FIGS. 4A, 4B, and 4C, the upset tool receiving feature [17] is a conical concavity, but other concave features, including a spherical depression, are within the scope of the invention as well. Furthermore, the accommodating recess feature [15], which is herein illustrated as a conic section, may have the form of a spherical vault, or any other sort of concavity offering sufficient clearance from the formed head of the adjacent bushing in the stack, that the necessary relative radial and tangential movement of the assembled rotor discs is afforded.

Furthermore, although the illustrated spacer formed of a strip material is shown as a 'U' shape, other shapes such as a 'Z' or a sigmoid will maintain desired disc spacing by means of its material thickness.

In addition, while the description of the preferred embodiment mentions polar arrays of spacing means, evincing especially of radial symmetry, the deployment of spacing means in Cartesian or non-orthogonal arrays also remains within the scope of the invention.

It is also of note that, for spacing means applied to a spacing disc as described in this invention, both the set of spacing means which maintain a design gap width between a spacer disc and a single adjacent disc, and the set of spacing means which maintain a design gap width between a spacer disc and two bilaterally adjacent discs, being the neighboring discs on both sides of the spacer disc, are within the scope of the invention. Thus included within the scope of the invention is a disc turbine rotor assembly in which spacer-laden discs alternate with ordinary discs, but also a disc turbine rotor assembly in which a sequential set of assembled discs all contain spacers, in mutual contact with each other upon assembly.

Furthermore, while the descriptions may imply that a given embodiment of a disc turbine rotor assembly which includes spacing means includes only one of the types of spacing means of this invention, a disc turbine rotor assembly including a heterogeneous combination of spacing means described in this invention also remains within the scope of this invention. A specific example includes a disc turbine rotor assembly which includes formed wire clips as spacing means on at least one location of at least a first disc, while including stamped and formed clip spacers at another location of said disc, or on a second disc, which also remains within the scope of the invention.

Figure 5A:
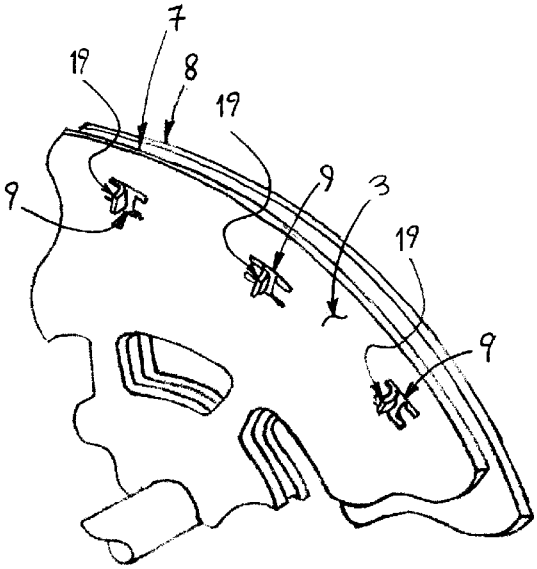
FIG. 5C illustrates a further spacing feature formed by punching a cruciform member [20] from the material comprising a spacing disc [7], and further deforming it by a permanent rotation so that two opposed cantilevers [19] simultaneously contact adjacent rotor discs [8]. In this configuration the two oppositely extending cantilevers form a rigid column [21].
Figure 5B:
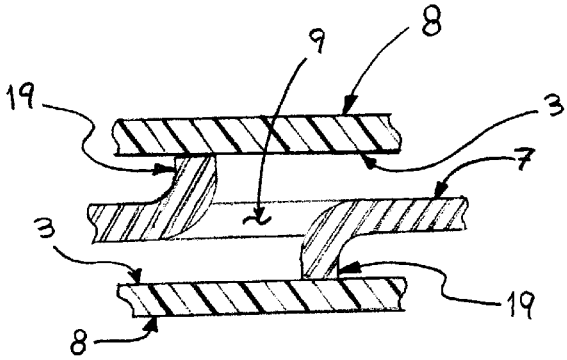
Figure 5C:
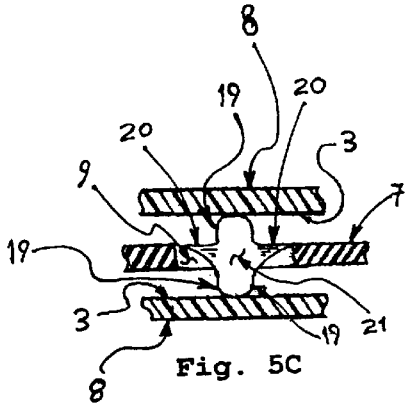

Referring to spacing means illustrated in FIGS. 5C and 5D, it is understood that spacing means arising from an aperture [9] which include a plurality of protrusions [20] conjoining to form more than one nexus [21] are also within the scope of this invention. So too are spacing means including a plurality of protrusions [20] conjoining to form more than one nexus [21], wherein the associated spacing protrusions [19] extend in only a first axial direction. Furthermore, while the preferred embodiments include apertures [9] in spacer discs [7] which are round or rectangular in shape, other shapes such as polygons and irregular shapes are within the scope of the invention. Also included within the scope of the invention are apertures with a non-symmetrical profile providing keying means or securing a special retention effect on the inserted spacers.

Also, the formed wire spacer of the preferred embodiment shown in FIG. 7A and 7B resembles a staple, but other formed wire shapes, such as those resembling a U-bolt, a hair pin, or a cotter pin, as well as those extending one or more than two extending legs 33, are also within the scope of the invention.

In the preferred embodiments of the snap-in spacer of FIG. 6C, the insertion act of installation is sufficient to secure said spacers for service. For the bushing spacer of FIG. 4B and the formed wire spacer of FIGS. 7A and 7B, installation including a post-insertion forming operation is preferable sufficient to secure said spacer for service. However, additional operations such as brazing, solder, welding, or adhesive, may be used to affix any of these sorts of the spacers to the discs, and these means are also within the scope of this invention.

Referring to the scalloped disc [34] illustrated in FIG. 8B, and described previously, it is further understood that pluralities of scalloped discs [34] presenting other arrangements of undulation waveforms, such as nonuniform amplitude and of various angular wavelengths within the scope of the invention, also regardless of phase or relative positional offset of wave features within the rotor disc assembly. A specific additional embodiment included within the scope of this invention is one in which all waves within a plurality of scalloped discs are parallel, of uniform amplitude, and in phase. It is further understood, however, that other arrangements of amplitude, angular wavelength, and phase are within the scope of this invention.

Thus the scope of the invention should be determined by the appended claims and their legal equivalents, rather than by the examples given.

What is claimed is:

1. A rotor assembly for a disc turbine, said rotor assembly comprising:

a shaft;

a plurality of discs mounted to said shaft for rotation therewith about an axis of rotation, each said disc comprising a disc membrane radially spaced from said axis of rotation and at least every other of said plurality of discs being a spacer disc provided with spacer means for maintaining a predetermined axial distance between the membranes of said discs, the membrane of said spacer discs defining a plurality of spacer receiving apertures, wherein said spacer means do not rigidly join any two adjacent discs and are axially aligned to form a spacer column extending the axial length of said rotor assembly, each said spacer means having a length and a lateral dimension perpendicular to said length, said spacer means passing through said aperture and fixed to said spacer disc such that said lateral dimension is disposed between said spacer disc membrane and the membranes of axially adjacent discs.

2. The rotor assembly of claim 1, wherein said spacer means comprise a plurality of spacers each comprising a strip of material having a thickness, said lateral dimension being said thickness.

3. The rotor assembly of claim 1, wherein said spacer means comprise a plurality of spacers each comprising a length of wire material having a diameter, said lateral dimension being said diameter.

4. A rotor assembly for a disc turbine, said rotor assembly comprising:

a shaft;

a plurality of discs mounted to said shaft for rotation therewith about an axis of rotation, each said disc comprising a disc membrane radially spaced from said axis of rotation, said plurality of discs comprising end discs at the axial end of said rotor assembly, each of said plurality of discs except for said end discs being a spacer disc provided with a plurality of spacer means for maintaining a predetermined axial distance between the membranes of said discs, said spacer means comprising:

a plurality of spacer receiving apertures through each said spacer disc membrane; and a plurality of spacers each comprising a shank integrally extending from an underside of a head having a thickness measured between the underside and a contact face, said head having a diameter greater than a diameter of said shank, wherein a spacer is retained in each said aperture by said shank with the head disposed between the membrane of the spacer disc and the membrane of an axially adjacent disc and said spacer means are axially aligned to form a spacer column extending the axial length of said rotor assembly.

5. The rotor assembly of claim 4, wherein the shank of an installed spacer axially projects from the spacer disc membrane opposite the head and each spacer head comprises a concavity in the contact face, said concavity configured to accommodate the axial projection of said shank from an adjacent disc such that said axial projection does not increase the spacing between adjacent discs beyond said thickness.

6. The rotor assembly of claim 4, wherein said shank comprises resilient legs projecting away from the underside of the head and terminating in lateral projections, said spacer installed by aligning said legs with an aperture and applying force toward the spacer disc causing said legs to flex inwardly to permit said lateral projections to pass through said aperture and when said lateral projections emerge from said aperture said legs rebound outwardly to retain the spacer to the disc.

7. The rotor assembly of claim 4, wherein the axially protruding portion of said shank is deformed to retain the spacer to the spacer disc.

8. A rotor assembly for a disc turbine, said rotor assembly comprising:

a shaft;

a plurality of discs mounted to said shaft for rotation therewith about an axis of rotation, each said disc comprising a disc membrane radially spaced from said axis of rotation and the membrane of at least every other of said plurality of discs being cut and twisted in at least one location of said disc membrane so as to provide opposed cantilevers as a column of material bilaterally projecting from the membrane and extending an opposed pair of axially spaced tips extending oppositely, wherein each of said oppositely extending tips define an axial spacing between a disc provided with said cantilevers and an adjacent disc membrane.

9. A rotor assembly for a disc turbine, said rotor assembly comprising:

a shaft;

a plurality of discs, each disc comprising a radially outer membrane and a plurality of vent openings radially inward of said membrane and defining a plurality of spokes, wherein said discs are mounted to said shaft for rotation therewith, each said disc mounted with an angular offset relative to a previous disc such that said vent openings form a helix as they progress in the axial direction.

10. The rotor assembly of claim 9, wherein said angular offset progresses continuously from one axial end of the rotor assembly to the other.

11. The rotor assembly of claim 9, wherein said angular offset is reversed at an axially central disc of said rotor assembly o form a first helix on one axial side of said axially central disc and a second helix on the other axial side of said axially central disc, said first and second helices having opposite directions of rotation.

12. The rotor assembly of claim 11, wherein said axially central disc has no vents and no spokes.

13. The rotor assembly of claim 11, comprising:

a plurality of spacers interspersed between said discs, each said spacer comprising a central hub and radial projections substantially similar in configuration to said spokes, wherein said spacers are angularly offset relative to an adjacent disc such that the radial projections are angularly offset from the spokes of an adjacent disc whereby the radial projections conform to the helix formed by the vents.

14. A rotor assembly for a disc turbine, said rotor assembly comprising:

a plurality of spaced apart discs mounted to a shaft for rotation therewith, said plurality of discs comprising:

a first series of substantially planar discs interspersed with a second series of discs, each having a pattern of axial protrusions, adjacent discs in said second series being angularly offset from each other; and means for applying and maintaining an axially compressive force on said rotor assembly whereby discs in said first series are deflected into an undulating form by the offset axial protrusions of adjacent discs in said second series.

* * * * *